US005993155A

United States Patent [19]

Endres et al.

[11] Patent Number: 5,993,155

[45] Date of Patent: Nov. 30, 1999

[54] COOLED GAS-TURBINE BLADE

[75] Inventors: Wilhelm Endres, Traunstein, Germany; Hans Wettstein, Fislisbach, Switzerland

[73] Assignee: Asea Brown Boveri AG, Baden, Switzerland

[21] Appl. No.: 09/034,231

[22] Filed: Mar. 4, 1998

[30] Foreign Application Priority Data

Mar. 29, 1997 [DE] Germany ..... 197 13 268

[51] Int. Cl.[6] ..... F01D 5/18

[52] U.S. Cl. ..... 416/96 R

[58] Field of Search ..... 415/115; 416/96 R, 416/96 A, 97 R

[56] References Cited

U.S. PATENT DOCUMENTS

| | | | |
|---|---|---|---|
| 2,667,326 | 1/1954 | Ledinegg | 416/96 R |
| 3,443,790 | 5/1969 | Buckland | 415/115 |
| 3,902,819 | 9/1975 | Holchendler et al. | 416/96 R |
| 4,156,582 | 5/1979 | Anderson | 416/96 R |
| 4,312,625 | 1/1982 | Pinaire | 416/96 R |

FOREIGN PATENT DOCUMENTS

| | | | |
|---|---|---|---|
| 1236279 | 3/1967 | Germany . | |
| 2345038 | 5/1974 | Germany . | |
| 2414397 | 10/1974 | Germany . | |
| 2426924 | 1/1975 | Germany . | |
| 2745892 | 4/1979 | Germany | 416/96 R |
| 3248161 | 7/1983 | Germany . | |
| 904546 | 8/1962 | United Kingdom | 416/96 R |

*Primary Examiner*—Christopher Verdier
*Attorney, Agent, or Firm*—Burns, Doane, Swecker & Mathis, L.L.P.

[57] ABSTRACT

A gas-turbine blade of solid construction and having cooling passages is specified, which cooling passages run in its interior and through which the cooling medium flows essentially from the blade root through the gas-turbine blade (100), these cooling passages (20) having a relatively small cross section in relation to the blade thickness and being arranged so as to run close to the lateral surface (100.1) of the gas-turbine blade (100), and the cooling-medium feed and discharge being effected in the base (60) of the gas-turbine blade (100).

3 Claims, 3 Drawing Sheets

COOLED GAS-TURBINE BLADE

BACKGROUND OF THE INVENTION

1. Field of the Invention

The invention relates to a cooled gas-turbine blade of solid construction.

2. Discussion of Background

Cooled gas-turbine blades are designed as hollow blades (DE-A 32 43 161—United Technologies), the outer walls of which are reinforced by internal ribs, which at the same time form at least one large cooling passage, which runs meander-like. A plurality of flow-diverting ribs and flow-separation beads are fitted at the walls into this large cooling passage in order to create a turbulent flow and thus encourage cooling. The cooling medium flows out through the blade walls and mixes with the fuel gas of the turbomachine.

A cooled turbine blade constructed in such a way is extremely complicated to manufacture and requires a very high degree of precision during manufacture. The manufacturing costs are in particular also very high because the blades resemble spatially twisted airfoils. In addition, a closed cooling circuit cannot be constructed, since the cooling medium is drawn off via fuel gas of the turbo-plant. In addition, the cooling in the various corners and angles in the interior of the cooled turbine blade is very difficult, since flow-diverting elements, which also permit a gas flow in these corners, have to be fitted. Such fitted parts make the manufacture of such turbine blades expensive and complicated. Yet overheating of the material may still occur in such corners.

SUMMARY OF THE INVENTION

Accordingly, one object of the invention, in attempting to avoid all of these disadvantages, is to provide a novel gas-turbine blade of solid construction which is simple to manufacture and in which the cooling medium is not a lost cooling medium and which is protected against local overheating.

This object is achieved by features of the present invention. Details of the embodiments of such a cooling system for a combined gas/steam-turbine plant are also described herein.

BRIEF DESCRIPTION OF THE DRAWINGS

A more complete appreciation of the invention nd many of the attendant advantages thereof will be readily obtained as the same becomes better understood by reference to the following detailed description when considered in connection with the accompanying drawings, wherein.

Only the elements essential for understanding the invention are shown; in particular, that part of the turbine blade which is unaltered and is known per se is not shown.

DESCRIPTION OF THE PREFERRED EMBODIMENTS

Figure 4:
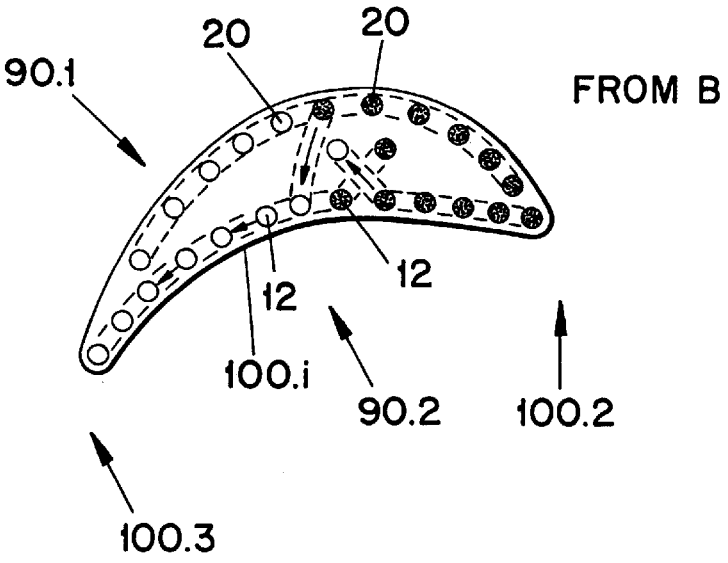
FIG. 4 schematically shows a view in direction B in FIG. 2 toward an end face of the turbine blade.

Referring now to the drawings, wherein like reference numerals designate identical or corresponding parts throughout the several views, cooling passages 20 are formed as fine, round tubules 20.i in the interior of a gas-turbine blade 100 of solid construction, and these cooling passages 20 start from a common feed 50 in the base 60 of the gas-turbine blade 100, run in a U-shape very close to the lateral surface 100.1 of the latter, and lead into a common discharge opening 80 in the base 60. In this case, the cooling passages 20 are designed as a number of U-shaped passages connected in parallel, each passage 20.i forming a branch of the cooling passages 20 and each leg of such a U-shaped branch forming a stem. The arrangement of the passages 20.i is now selected in such a way that in each case stems of two different branches always come to lie in an adjacent position. That is to say that, for example, a feed-line stem of one branch, i.e. a leg of a U-shaped branch in which the cooling medium is fed, has a feed-line or discharge-line stem of another branch arranged next to it. This has the important advantage that, if a branch becomes obstructed by a contaminant, e.g. of a scale particle, etc., entrained in the cooling medium, a larger area is not affected, since the adjacent branch is generally not also obstructed and thus cools the turbine blade. If the feed-line stem and discharge-line stem of a branch were arranged directly next to one another, a build-up of heat would occur, in particular in the region between the two stems, a factor which may damage the turbine blade. In the embodiment according to the invention, however, in particular given suitable dimensioning, the region of a failed neighboring stem is also cooled. As FIG. 4 shows, a branch may be arranged with one of its stems on one side of the turbine blade, e.g. the suction side 90.1, and the other stem of the same branch may lie on the other side of the turbine blade, the pressure side 90.2. At the same time, a number of the other U-shaped branches may each be nested one inside the other on each side of the turbine blade. It can be even better if, instead of only one branch whose stems lie in an adjacent position to different blade sides, two or more branches have stems which lie on different blade sides. In this embodiment, the feeding with cooling medium is effected in the stems in the region of the leading edge 100.2 via the base 60 of the turbine blade 100, and the discharge of the cooling medium is effected in the stems of the trailing edge 100.3. Parallel-flow cooling of the gas-turbine blade is thus realized. However, the individual branches or their stems may also be interconnected in a more complex form, so that a combination of parallel-flow cooling and counterflow cooling can be realized.

By such passage cooling of a gas-turbine blade, it is possible, depending on the thermal conditions, to feed fresh cooling medium in a specific manner over the course of a lateral surface of a turbine blade and thus cool blade regions in a highly selective manner. For example, instead of the discharge passage 12, a feed passage could be arranged in FIG. 4 in order to thus cope with the thermal loading locally in a more effective manner.

Figure 1:
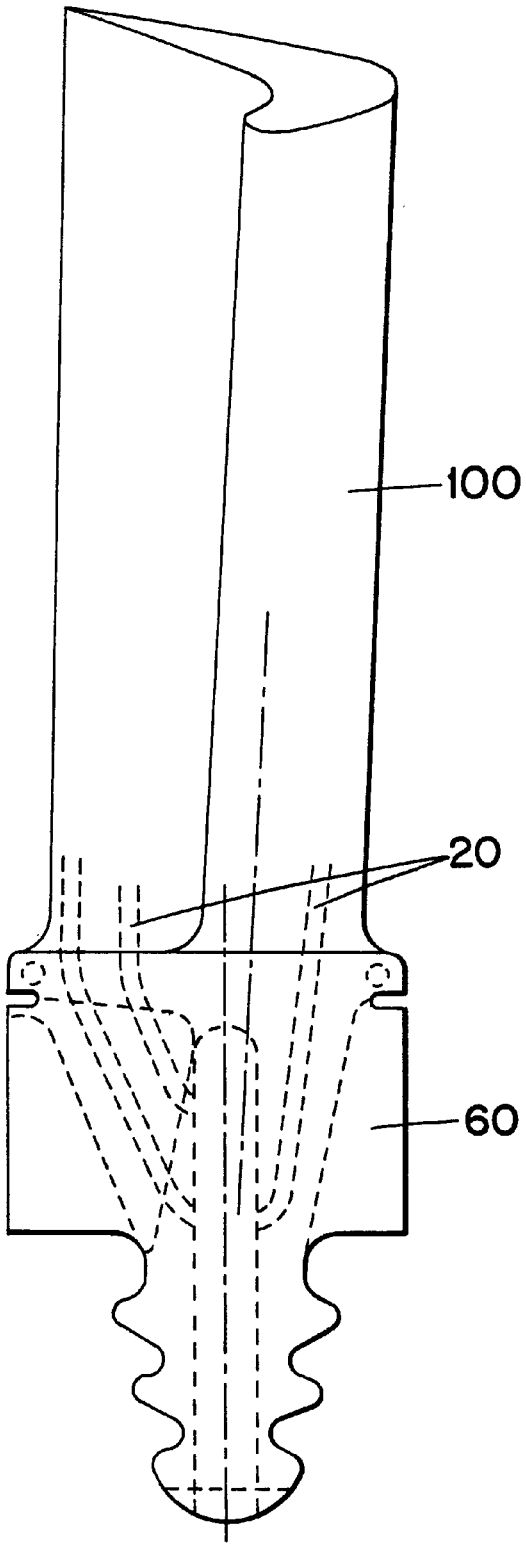
FIG. 1 schematically shows a turbine blade in a view toward the leading edge.
Figure 2:
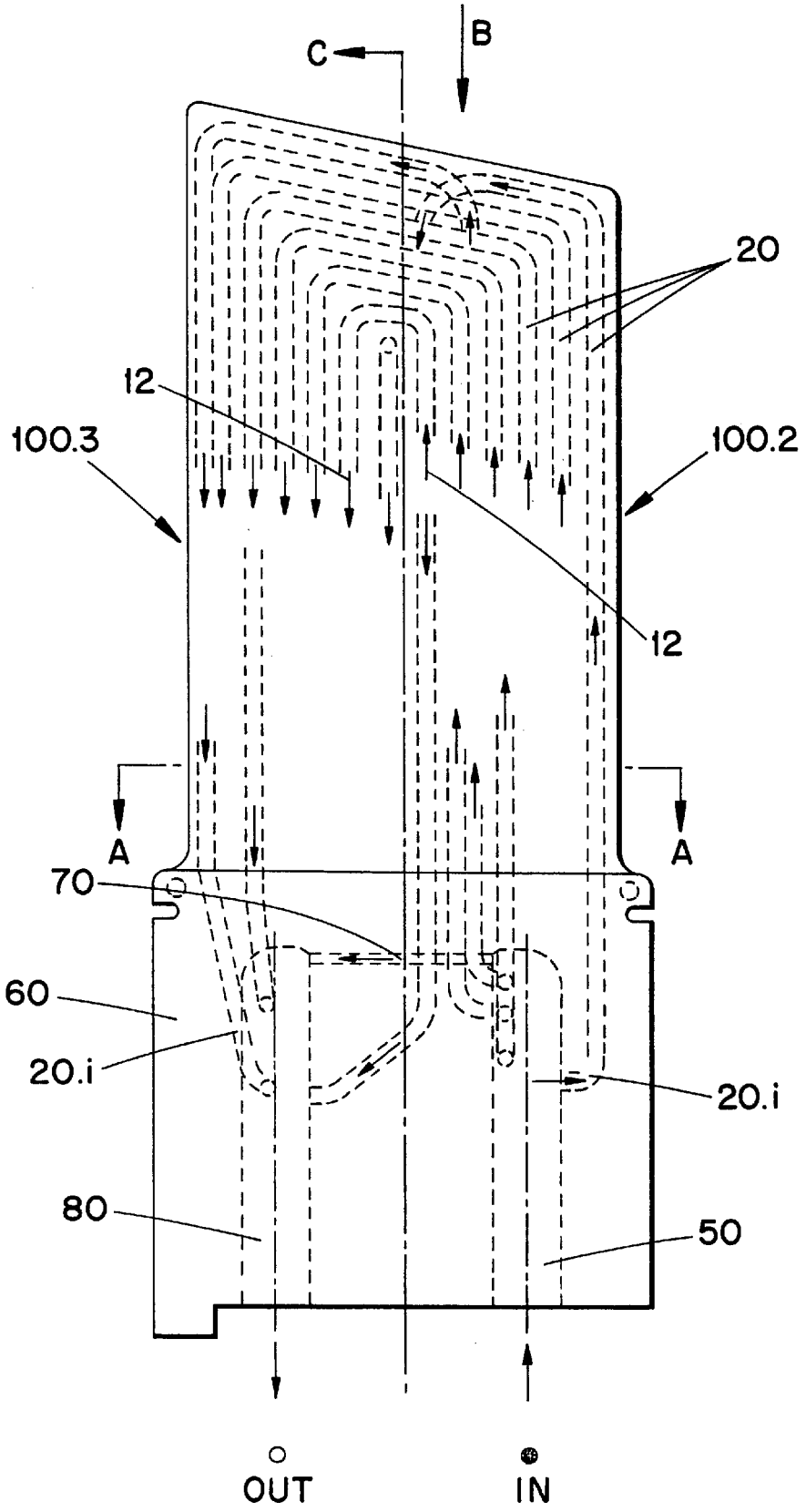
FIG. 2 schematically shows a view toward a flow surface of the turbine blade.
Figure 3:
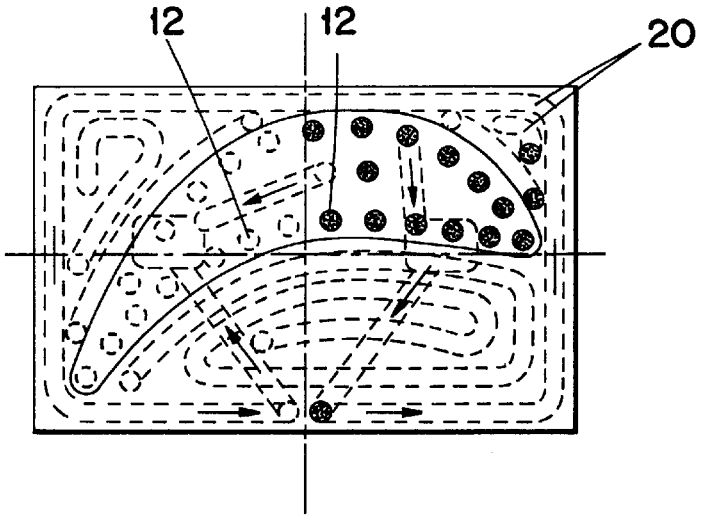
FIG. 3 schematically shows a section of the turbine blade according to A—A in FIG. 2.
Figure 5:
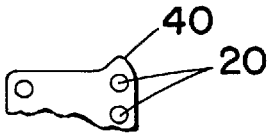
FIG. 5 schematically shows a detail at the end face of the turbine blade.

So that the transition stem, which connects the two U-legs and lies directly adjacent to the end face of the turbine blade, is not damaged in the event of any stator contact, e.g. caused by temporary vibrations, etc., a collision bead 40 is provided (FIG. 5). As can be seen from FIG. 3, the base of the turbine blade also has cooling passages 20.

A bypass line 70 is provided in the region of the base 60 of the gas-turbine blade 100 so that particles entrained in the cooling medium are not allowed to pass into the cooling passages 20.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A cooled gas-turbine blade of solid construction comprising:

a blade having a lateral surface, a blade thickness, a blade root, a blade tip, a cooling-medium feed, a cooling medium discharge, and cooling passages which run in the interior of the blade through which cooling passages cooling medium can flow from said blade root through said blade to cool said blade, wherein said cooling passages have a relatively small cross section in relation to said blade thickness and are arranged so as to run close to said blade lateral surface, said cooling-medium feed and cooling-medium discharge being formed in said blade root, wherein each of said cooling passages comprises a U-shaped branch, and wherein each of said cooling passages is fluidly separated from other cooling passages from said cooling-medium feed to said cooling-medium discharge.

2. The gas-turbine blade as claimed in claim 1, wherein said cooling passage branches each include two stems, and said cooling passage branches are nested one inside the other so that each stem of a branch is essentially the neighbor of another branch.

3. A cooled gas-turbine blade of solid construction comprising:

a blade having a lateral surface, a blade thickness, a blade root, a blade tip, a cooling-medium feed, a cooling medium discharge, and cooling passages which run in the interior of the blade through which cooling passages cooling medium can flow from said blade root through said blade to cool said blade, wherein said cooling passages have a relatively small cross section in relation to said blade thickness and are arranged so as to run close to said blade lateral surface, said cooling-medium feed and cooling-medium discharge being formed in said blade root; and a bypass line in said blade root fluidly communicating said cooling-medium feed and said cooling medium discharge so that when cooling medium is caused to flow from said cooling-medium feed, through said cooling passages, and out said cooling-medium discharge, particles entrained in said cooling medium are not allowed to pass into said cooling passages.

* * * * *